US008241189B2

(12) United States Patent
Kanaoka

(10) Patent No.: US 8,241,189 B2
(45) Date of Patent: Aug. 14, 2012

(54) DUMBBELL

(76) Inventor: Nobuaki Kanaoka, Toyonaka (JP)

( * ) Notice: Subject to any disclaimer, the term of this patent is extended or adjusted under 35 U.S.C. 154(b) by 0 days.

(21) Appl. No.: 12/573,329

(22) Filed: Oct. 5, 2009

(65) Prior Publication Data

US 2010/0087297 A1 Apr. 8, 2010

(30) Foreign Application Priority Data

Oct. 6, 2008 (JP) ..... 2008-259999
Nov. 27, 2008 (JP) ..... 2008-303069
Jul. 22, 2009 (JP) ..... 2009-171418

(51) Int. Cl.
*A63B 21/072* (2006.01)
*A63B 21/075* (2006.01)
*A63B 23/16* (2006.01)

(52) U.S. Cl. ..... 482/108; 482/50

(58) Field of Classification Search ..... 482/108, 482/106–107, 109, 45–46, 44, 49–50
See application file for complete search history.

(56) References Cited

U.S. PATENT DOCUMENTS 460,270 A * 9/1891 Somerby ..... 482/108
734,062 A * 7/1903 Harris ..... 482/108
793,101 A * 6/1905 Schmidt ..... 482/108
825,955 A * 7/1906 Bohache ..... 482/108
1,013,782 A * 1/1912 Koch ..... 482/108
1,229,658 A * 6/1917 Sandow ..... 482/50
1,917,566 A * 7/1933 Wood ..... 482/108
2,223,574 A * 12/1940 Paves ..... 482/108
2,676,802 A * 4/1954 O'Brien ..... 482/106
3,310,331 A * 3/1967 Honore ..... 294/26
3,482,835 A * 12/1969 Dean ..... 482/108
3,756,597 A * 9/1973 Monti ..... 482/106
3,904,198 A * 9/1975 Jones ..... 482/106
4,043,553 A * 8/1977 Suarez ..... 482/110
4,079,932 A * 3/1978 Schuetz ..... 482/82
4,103,887 A * 8/1978 Shoofler ..... 482/106
4,199,140 A * 4/1980 Ferretti ..... 482/106
4,231,569 A * 11/1980 Rae ..... 482/108
4,288,073 A * 9/1981 Petrachonis et al. ..... 482/106
4,312,506 A * 1/1982 Brennan ..... 482/108
4,328,965 A * 5/1982 Hatfield ..... 482/122
4,340,990 A * 7/1982 Seynhaeve ..... 16/445
4,377,282 A * 3/1983 Hayes ..... 482/44
4,380,231 A * 4/1983 Rocha et al. ..... 601/118

(Continued)

FOREIGN PATENT DOCUMENTS

GB 2230708 A * 10/1990

(Continued)

OTHER PUBLICATIONS

Front page of Website "FANTASBELL" with its computer translation, http://www.fantaspro.com/ , Aug. 8, 2009 uploaded.

*Primary Examiner* — Loan Thanh
*Assistant Examiner* — Daniel F Roland
(74) *Attorney, Agent, or Firm* — Buchanan Ingersoll & Rooney PC

(57) ABSTRACT

A dumbbell of the present invention includes: a handle portion having a flattened cross section; and at least two weight portions provided at opposite ends of the handle portion. The handle portion is connected to an off-center position deviating from a center-of-gravity portion of each of the weight portions.

11 Claims, 17 Drawing Sheets

U.S. PATENT DOCUMENTS 4,531,728 A * 7/1985 Wright ..... 482/106
4,605,221 A * 8/1986 D'Agosta ..... 482/8
4,605,222 A * 8/1986 Shannon ..... 482/108
4,607,840 A * 8/1986 Harper ..... 482/109
4,641,836 A * 2/1987 Clifton ..... 482/109
4,712,794 A * 12/1987 Hall ..... 482/74
4,722,523 A * 2/1988 Yang ..... 482/108
4,743,017 A * 5/1988 Jaeger ..... 482/108
4,756,526 A * 7/1988 Broussard ..... 482/108
4,768,780 A * 9/1988 Hayes ..... 482/108
4,863,158 A * 9/1989 Tassone ..... 482/140
4,867,444 A * 9/1989 Castillo ..... 482/106
4,880,229 A * 11/1989 Broussard ..... 482/108
5,221,244 A * 6/1993 Doss ..... 482/106
5,242,350 A * 9/1993 Chang ..... 482/108
5,266,069 A * 11/1993 Thorne ..... 482/111
5,281,192 A * 1/1994 Nelson ..... 482/93
5,312,314 A * 5/1994 Stephan et al. ..... 482/110
5,325,997 A * 7/1994 Washington et al. ..... 222/175
5,332,119 A * 7/1994 Davis ..... 222/78
5,399,135 A * 3/1995 Azzouni ..... 482/106
5,435,800 A * 7/1995 Nelson ..... 482/108
5,457,832 A * 10/1995 Tatum ..... 5/636
5,478,312 A * 12/1995 Weissbuch ..... 482/111
5,527,240 A * 6/1996 Chen ..... 482/44
5,529,550 A * 6/1996 Maycock et al. ..... 482/44
5,569,125 A * 10/1996 Clementi ..... 482/46
5,573,484 A * 11/1996 Carpenter ..... 482/108
5,582,402 A * 12/1996 Gilford ..... 473/450
5,647,076 A * 7/1997 Gearhart ..... 5/631
5,651,758 A * 7/1997 Cervantes ..... 482/93
5,716,305 A * 2/1998 Selsam ..... 482/93
5,720,700 A * 2/1998 Buoni et al. ..... 482/124
5,788,617 A * 8/1998 Paris ..... 482/112
D398,676 S * 9/1998 Marney ..... D21/681
5,823,922 A * 10/1998 Eckmann ..... 482/108
6,196,951 B1 * 3/2001 Shepherd ..... 482/106
6,217,494 B1 * 4/2001 Sandoval ..... 482/106
6,398,694 B1 * 6/2002 Bountourakis ..... 482/44
6,406,406 B1 * 6/2002 Onorati ..... 482/44
6,514,109 B1 * 2/2003 Carlow ..... 440/101
6,730,004 B2 * 5/2004 Selsam ..... 482/93
6,979,285 B2 * 12/2005 Lovison ..... 482/95
7,112,164 B1 * 9/2006 Hoagland ..... 482/106
7,381,167 B2 * 6/2008 Duhamel ..... 482/108
7,401,385 B2 * 7/2008 Martin et al. ..... 16/444
7,458,921 B2 * 12/2008 Hallar ..... 482/106
7,824,312 B1 * 11/2010 Hsu ..... 482/49
7,958,582 B1 * 6/2011 Scamardo ..... 5/632
7,963,891 B1 * 6/2011 Zeaman ..... 482/104
2002/0187883 A1 * 12/2002 Lovison ..... 482/108
2003/0083179 A1 * 5/2003 Landfair ..... 482/93
2004/0033867 A1 * 2/2004 Katami ..... 482/109
2006/0003876 A1 * 1/2006 Duhamel ..... 482/106
2006/0199709 A1 * 9/2006 Shepherd ..... 482/109
2007/0142755 A1 * 6/2007 Kleiman ..... 601/120
2008/0070762 A1 * 3/2008 White ..... 482/108
2008/0070764 A1 * 3/2008 Amzallag et al. ..... 482/129
2008/0076647 A1 * 3/2008 Fine ..... 482/126
2008/0096737 A1 * 4/2008 Ayoub ..... 482/107
2008/0220952 A1 * 9/2008 Yang ..... 482/107
2009/0258765 A1 * 10/2009 Panicali ..... 482/106
2010/0137113 A1 * 6/2010 Marethouse et al. ..... 482/107

FOREIGN PATENT DOCUMENTS

JP 59-8360 U 1/1984
JP 60-92555 U 6/1985
JP 60-102038 U 7/1985
JP 62-50661 U 3/1987
JP 62-503075 A 12/1987
JP 63-290587 A 11/1988
JP 7-204292 A 8/1995
JP 8-318006 A 12/1996
JP 11-216199 A 8/1999
JP 1140495 S 5/2002
JP 1183583 S 9/2003
JP 1215761 S 8/2004
JP 2004-255006 A 9/2004
JP 2004-305685 A 11/2004
JP 3113965 U 9/2005
JP 2007-160041 A 6/2007
JP 4229397 B1 2/2009

* cited by examiner

DUMBBELL

BACKGROUND OF THE INVENTION

1. Field of the Invention

The present invention relates to a dumbbell, and more particularly to a dumbbell having a handle portion attached to weight portions at positions deviating from the centers of gravity of the weight portions.

2. Description of the Background Art

Dumbbells made of iron, lead, etc., are known in the art for use in increasing the muscular power in the wrist, the shoulder, the arm, etc. A dumbbell includes a shaft, serving as a handle portion, and weights in a disc shape, a plate shape, a spherical shape, or the like, symmetrically attached at the opposite ends of the shaft. In order to increase the muscular power, one swings the dumbbell back and forth while gripping the shaft portion, with the shoulder, elbow, wrist, etc., serving as the fulcrum.

FIG. 24 is a view showing a wrist curl as an exercise example using a conventional dumbbell 90. The conventional dumbbell 90 includes weight portions 92 attached at the opposite ends of a handle portion 91. With an arm 94 resting on a bench 93, the dumbbell 90 is swung up and down with the wrist serving as the fulcrum. This increases the muscular power of the forearm.

Patent Document 1: Japanese Laid-Open Patent Publication No. 2007-160041

Patent Document 2: Japanese Design Registration No. 1215761

Patent Document 3: Japanese Laid-Open Patent Publication No. 8-318006

Patent Document 4: Japanese Laid-Open Patent Publication No. 63-290587

Patent Document 5: Japanese Laid-Open Utility Model Publication No. 62-50661

Patent Document 6: Japanese National Phase PCT Laid-Open Publication No. 62-503075

Patent Document 7: Japanese Laid-Open Utility Model Publication No. 59-8360

Patent Document 8: Japanese Design Registration No. 1140495

Patent Document 9: Japanese Laid-Open Utility Model Publication No. 60-92555

Patent Document 10: Japanese Laid-Open Patent Publication No. 7-204292

Patent Document 11: Japanese Laid-Open Patent Publication No. 2004-255006

Patent Document 12: Japanese Laid-Open Patent Publication No. 11-216199

Patent Document 13: Japanese Design Registration No. 1183583

Patent Document 14: Japanese Laid-Open Utility Model Publication No. 60-102038

PROBLEMS TO BE SOLVED BY THE INVENTION

The center of gravity of the conventional dumbbell 90 is at the center of the handle portion. Therefore, the wrist needs to be maximally swung up and down across the entire range of motion of the wrist. Since the load of the weights acts directly upon the wrist joint, there is a heavy load on the wrist joint.

In the dumbbell disclosed in Patent Document 1, the columnar handle portion can be shifted off the centers of the weight portions (see, for example, FIG. 8 of Patent Document 1). Patent Document 1 states that shifting the handle portion off the centers of the weight portions gives a better training for the wrist. Note however that the handle portion shown in Patent Document 1 has a circular cross section. As shown in FIG. 13 to be referred to later, if the columnar handle portion is shifted off the centers of the weight portions, one needs to firmly grip the handle portion in order to prevent the weight portions from rotating. This requires a certain level of grip for holding the handle portion, and although this strengthens the grip, it fails to effectively strengthen the forearm.

Also in the dumbbells disclosed in Patent Documents 2, 4 to 7, the handle portions are columnar, and thus the same problem arises as that of the dumbbell of Patent Document 1. Also in the exercise system disclosed in Patent Document 3, the grip is generally columnar, and thus the same problem arises as that of the dumbbell of Patent Document 1.

Also with the dumbbells disclosed in Patent Documents 8, 9 and 10, the handle portion needs to be firmly gripped in order to prevent the weight portion from rotating.

In the dumbbells disclosed in Patent Documents 11 to 14, there is a certain angular relationship between the shaft portion and the weight portions. However, this is only a structure that gives a better contact between the dumbbell and the hand to facilitate the grip, and it cannot be said that this is a dumbbell suitable for strengthening the forearm.

As described above, none of the dumbbells disclosed in Patent Documents 1 to 14 is optimized for strengthening the forearm.

In any sport in which the arm is used, the wrist is the final part of the kinetic chain. Moreover, since the wrist is a joint, it serves as a shock absorber and absorbs a force from an upper limb or an external pressure. Therefore, if the wrist is weak and a strong kinetic energy is applied thereto from an upper limb or an external pressure, the wrist will not tolerate the kinetic energy and will be broken. Moreover, while in most sports one moves the whole body using the wrist as a key part in the kinetic chain to achieve a certain goal, conventional strength training exercises often aim at strengthening an intended muscle or muscles while minimizing the load on the wrist. With such conventional strength training exercises, where only certain muscle parts of interest are strengthened, one cannot be trained in such a manner that suits actual match play, and it is difficult to train aiming to achieve a muscular balance that suits a particular sport.

In view of this, there is a demand for equipment with which the wrist can be strengthened effectively and adequately. To strengthen the wrist as used herein means to strengthen the forearm from the elbow up to the wrist joint. The grip can be improved by strengthening muscles in the palm and the fingers. For actual sports, however, it is necessary to improve the muscular power of the forearm, as well as the grip. The forearm can be strengthened selectively by a wrist curl using a conventional dumbbell, which however may injure the wrist. Moreover, such an exercise as a wrist curl using a conventional dumbbell, where the muscular power of only the forearm is improved, cannot provide a practical training exercise that also strengthens other muscle parts while strengthening the forearm.

SUMMARY OF THE INVENTION

Therefore, it is an object of the present invention to provide a dumbbell suitable for strengthening the wrist, i.e., the forearm. It is also an object of the present invention to provide a dumbbell with which the forearm can be strengthened by only holding the dumbbell and with which other muscle parts can also be strengthened while holding the dumbbell, and to thereby provide a dumbbell with which the muscular power can be strengthened with such a balance that is called for in actual match play of a sport.

The present invention has the following features to attain the objects mentioned above. The present invention is directed to a dumbbell including: a handle portion having a flattened cross section; and at least two weight portions provided at opposite ends of the handle portion. The handle portion is connected to an off-center position deviating from a center-of-gravity portion of each of the weight portions.

Preferably, a crossing angle between a direction from the off-center position toward the center-of-gravity portion and a longitudinal direction of the handle portion is larger than 0° and smaller than 90°. Preferably, a weight of a portion of the weight portion that is on an opposite side to a side of the center-of-gravity portion with respect to the off-center position being a boundary is less than 10% a total weight of the weight portion. Preferably, the crossing angle is 40° or more and 50° or less. For example, the handle portion is preferably provided with a mark indicating an orientation of the weight portion when the handle portion is held. For example, the handle portion includes a depressed portion having a size of a fingertip. The depressed portion preferably indicates an orientation of the weight portion when the handle portion is held. For example, the weight portion is preferably provided with a mark indicating an orientation of the weight portion when the handle portion is held. For example, the dumbbell preferably further includes a connecting weight portion that connects together the two weight portions.

Preferably, a crossing angle between a direction from the off-center position toward the center-of-gravity portion and a longitudinal direction of the handle portion is 0° or 90°. Preferably, a weight of a portion of the weight portion that is on an opposite side to a side of the center-of-gravity portion with respect to the off-center position being a boundary is less than 10% a total weight of the weight portion.

Preferably, an ellipticity of a cross section of the handle portion is 0.3 or more and less than 1.

Preferably, a cross section of the handle portion has an oblate shape, an elliptic shape, a rounded rectangular shape or a beveled rectangular shape.

According to the present invention, since the handle portion has a flattened cross section, the handle portion is held in a certain fixed orientation. Thus, there is a moment from the weight portions, with which one can strengthen the forearm. Therefore, it is possible to strengthen the forearm by only holding the dumbbell, and it is possible to strengthen other muscle parts while holding the dumbbell. Thus, the dumbbell is suitable for strengthening the forearm, and it is possible with the dumbbell to strengthen the muscular power with such a balance that is called for in actual match play of a sport. Moreover, there is provided a dumbbell with which the wrist joint is less likely to be injured.

By setting the crossing angle to be larger than 0° and smaller than 90°, there is a moment from the weight portions with which the forearm can be strengthened with any angle of the arm. There is a moment from the weight portions even while the dumbbell is held still. There is a moment from the weight portions also when one is moving the arm around while holding the dumbbell. As the weight of a portion of the weight portion on the opposite side to the side of the center-of-gravity portion is less than 10% the total weight of the weight portion, it is possible to minimize the amount of weight to be canceled out. Therefore, it is possible to provide a dumbbell that is light-weight and yet enables effective strengthening of the forearm. If the crossing angle is set to be 40° or more and 50° or less, it is possible to better generate a moment from the weight portions under various situations. Therefore, there is provided a dumbbell with which it is possible to effectively strengthen the forearm. By providing the handle portion with a mark indicating the orientation of the weight portion, providing a depressed portion in the handle portion, or providing the weight portion with a mark indicating the orientation of the weight portion, even a person who has never used a dumbbell of the present invention before can properly grasp the orientation of the weight portion, thus improving the usability. By further providing a connecting weight portion, it is possible to increase the load.

By setting the crossing angle to be 0° or 90°, there is a moment from the weight portions with which it is possible to strengthen the forearm, depending on the position of the dumbbell. There is a moment from the weight portions even while the dumbbell is held still, depending on the position of the dumbbell. There is also a moment from the weight portions even when one is moving the arm around while holding the dumbbell, depending on the position of the dumbbell. By setting the weight of a portion of the weight portion on the opposite side to the side of the center-of-gravity portion to be less than 10% the total weight of the weight portion, it is possible to minimize the amount of weight to be canceled out. Therefore, it is possible to provide a dumbbell that is light-weight and yet enables effective strengthening of the forearm.

By setting the ellipticity of the cross section of the handle portion to be 0.3 or more and less than 1, the handle portion is more reliably held in a fixed orientation, and it is therefore possible to effectively generate a moment from the weight portions.

If the cross section of the handle portion has an oblate shape, an elliptic shape, a rounded rectangular shape or a beveled rectangular shape, it is possible to provide a simple and inexpensive dumbbell.

These and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
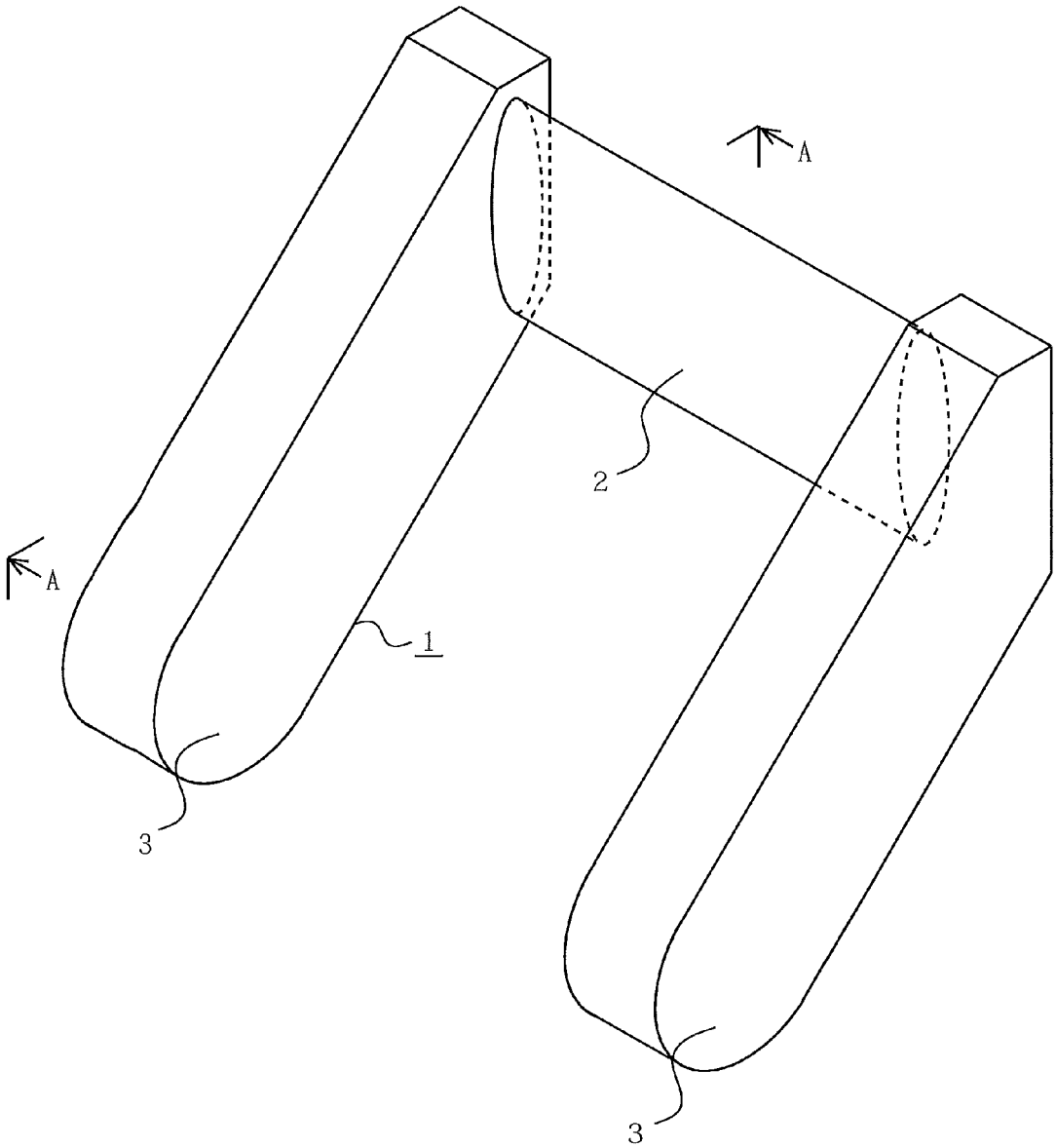
FIG. 1 is a perspective view showing a dumbbell 1 according to an embodiment of the present invention.
Figure 2:
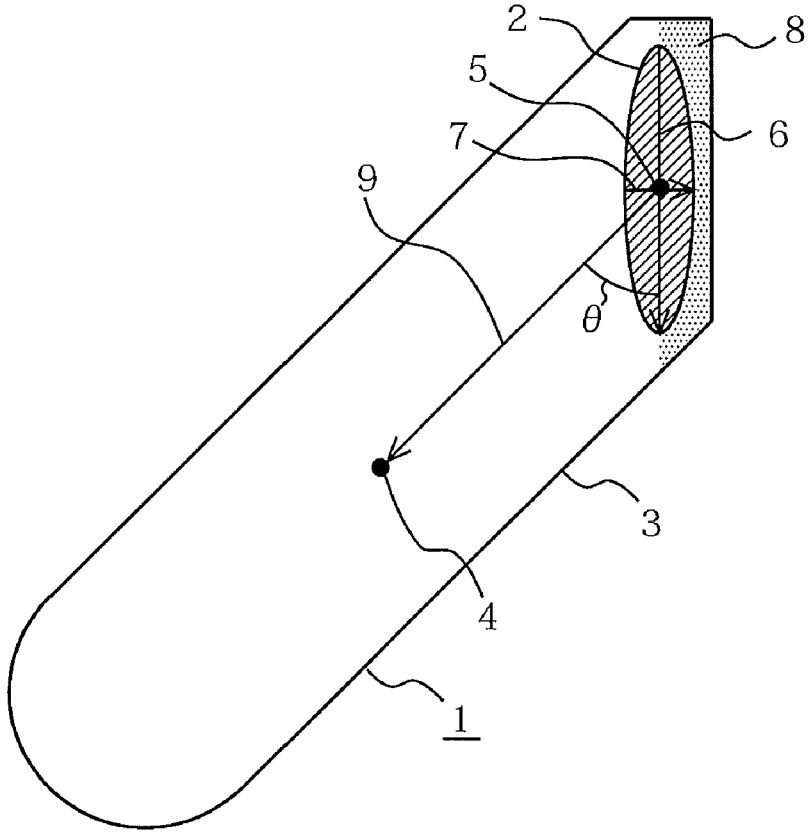
FIG. 2 is a cross-sectional view taken along plane A-A in FIG. 1.

FIG. 1 is a perspective view showing a dumbbell 1 according to an embodiment of the present invention. Referring to FIG. 1, the dumbbell 1 includes a handle portion 2 and two weight portions 3. FIG. 2 is a cross-sectional view taken along plane A-A in FIG. 1. The handle portion 2 has a flattened cross section, and has an elliptic cross section in the example shown in FIG. 2. The two weight portions 3 are connected to the opposite ends of the handle portion 2. Referring to FIG. 2, the handle portion 2 is connected to an off-center position 5 deviating from a center-of-gravity portion 4 of each weight portion 3. The crossing angle θ between a direction 9 from the off-center position 5 toward the center-of-gravity portion 4 and a longitudinal direction 6 of the handle portion 2 is 45°. Note that the crossing angle θ may be any angle that is larger than 0° and smaller than 90°, and is preferably 40° or more and 50° or less. The weight portion 3 is in a rectangular plate shape with its tip rounded for safety. In the present invention, the shape of the weight portion 3 is not limited to any particular shape, and may be, for example, a columnar shape, a semi-columnar shape, a spherical shape, or a polygonal prism shape.

A region 8 that is shaded with dots in FIG. 2 is a portion of the weight portion 3 that is on the opposite side to the side of the center-of-gravity portion 4 with respect to the off-center position 5 being the boundary. The off-center position 5 is so determined that the weight of the weight portion 3 in the region 8 is as small as possible. This is because when the handle portion 2 is held, the weight of the region 8 and a corresponding part of the weight of the remaining portion are canceled out by each other, thereby relatively reducing the load of the remaining portion. Preferably, the weight of the region 8 is less than 10% that of the weight portion 3.

Figure 3A:
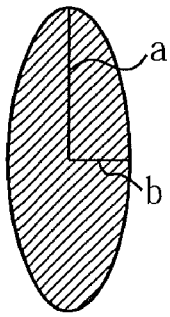
FIG. 3A is a view showing an alternative example of the cross section of a handle portion 2.
Figure 3B:
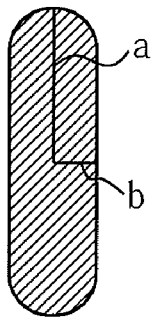
FIG. 3B is a view showing an alternative example of the cross section of the handle portion 2.
Figure 3C:
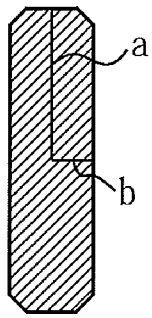
FIG. 3C is a view showing an alternative example of the cross section of the handle portion 2.

The ellipticity of the elliptic cross section of the handle portion 2 is 0.3 or more and less than 1. The ellipticity as used herein is represented as "(a−b)/a", where "a" denotes half the length of a long side 6, and "b" denotes half the length of a short side 7. Products made by the present inventor have ellipticities of about 0.4 to 0.5. It has been demonstrated that the forearm can be strengthened effectively with such an shape. In the present invention, the cross section of the handle portion 2 may be any flattened shape, and is not limited to an ellipse. FIGS. 3A to 3C are views showing alternative examples of the cross section of the handle portion 2. The cross section of the handle portion 2 may be an oblate shape, as shown in FIG. 3A. The cross section of the handle portion 2 may be a rectangular shape with rounded corners, as shown in FIG. 3B. The cross section of the handle portion 2 may be a beveled rectangular shape with beveled corners, as shown in FIG. 3C. As shown in FIGS. 3A to 3C, the ellipticity as used herein is not limited to the oblateness of an ellipse, and can be represented generally as "(a−b)/a", where "a" denotes half the length in the longitudinal direction, and "b" denotes half the length in the width direction.

Figure 4:
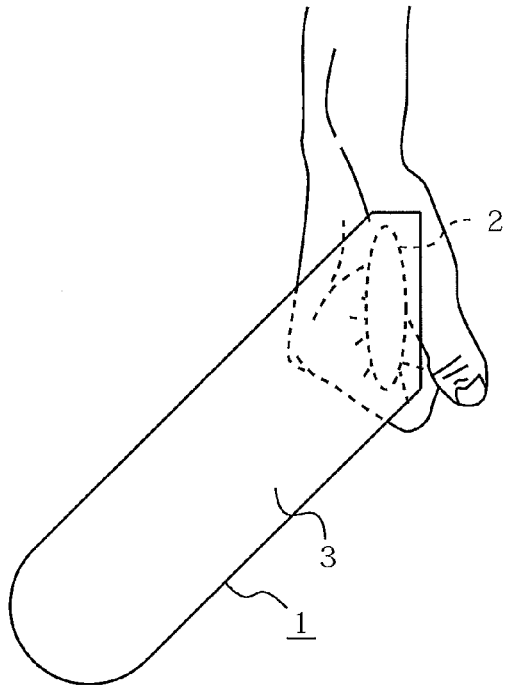
FIG. 4 is a view showing a state where the handle portion 2 is held so that the tip of a weight portion 3 points downward and to the lateral side of the arm.
Figure 5:
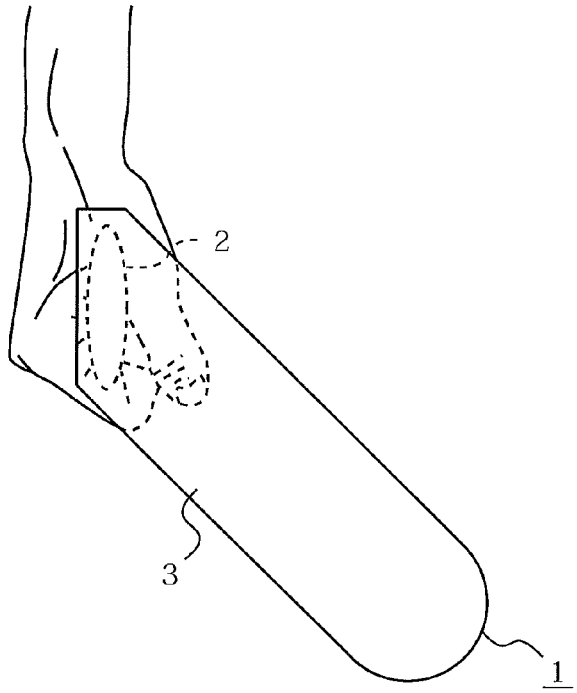
FIG. 5 is a view showing a state where the handle portion 2 is held so that the tip of the weight portion 3 points downward and to the medial side of the arm.
Figure 6:
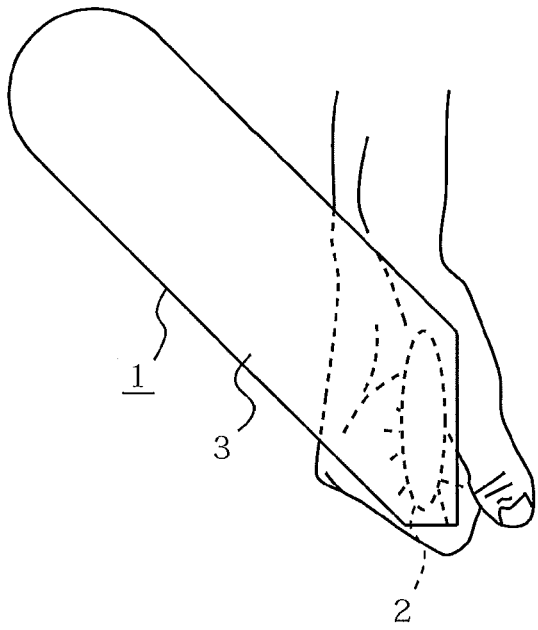
FIG. 6 is a view showing a state where the handle portion 2 is held so that the tip of the weight portion 3 points upward and to the lateral side of the arm.
Figure 7:
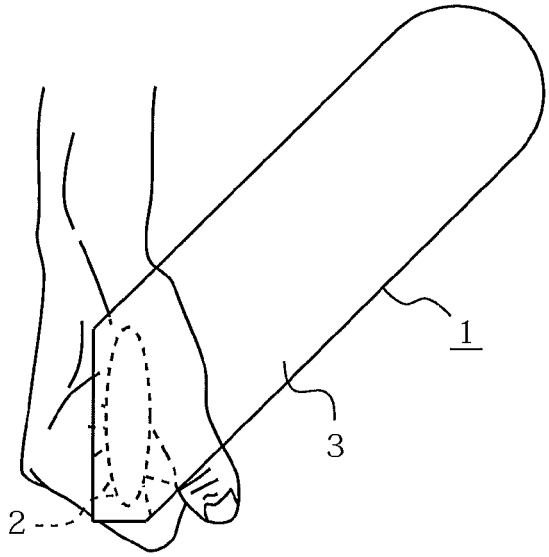
FIG. 7 is a view showing a state where the handle portion 2 is held so that the tip of the weight portion 3 points upward and to the medial side of the arm.

Next, example exercises using the dumbbell 1 will be described. FIG. 4 is a view showing a state where the handle portion 2 is held so that the tip of the weight portion 3 points downward and to the lateral side of the arm. FIG. 5 is a view showing a state where the handle portion 2 is held so that the tip of the weight portion 3 points downward and to the medial side of the arm. FIG. 6 is a view showing a state where the handle portion 2 is held so that the tip of the weight portion 3 points upward and to the lateral side of the arm. FIG. 7 is a view showing a state where the handle portion 2 is held so that the tip of the weight portion 3 points upward and to the medial side of the arm. In these states, the handle portion 2 is held in the palm so that its longitudinal axis lies vertically downward.

Since the handle portion 2 and the weight portions 3 cross each other at a predetermined angle, the weight portion 3 is urged to rotate about the off-center position of the handle portion 2 when the handle portion 2 is held as shown in FIGS. 4 to 7. Therefore, each position of the dumbbell 1 is kept by the arm exerting a force resisting the moment from the weight portions 3. Particularly, the position of the dumbbell 1 is kept by using muscles in the forearm.

Figure 8:
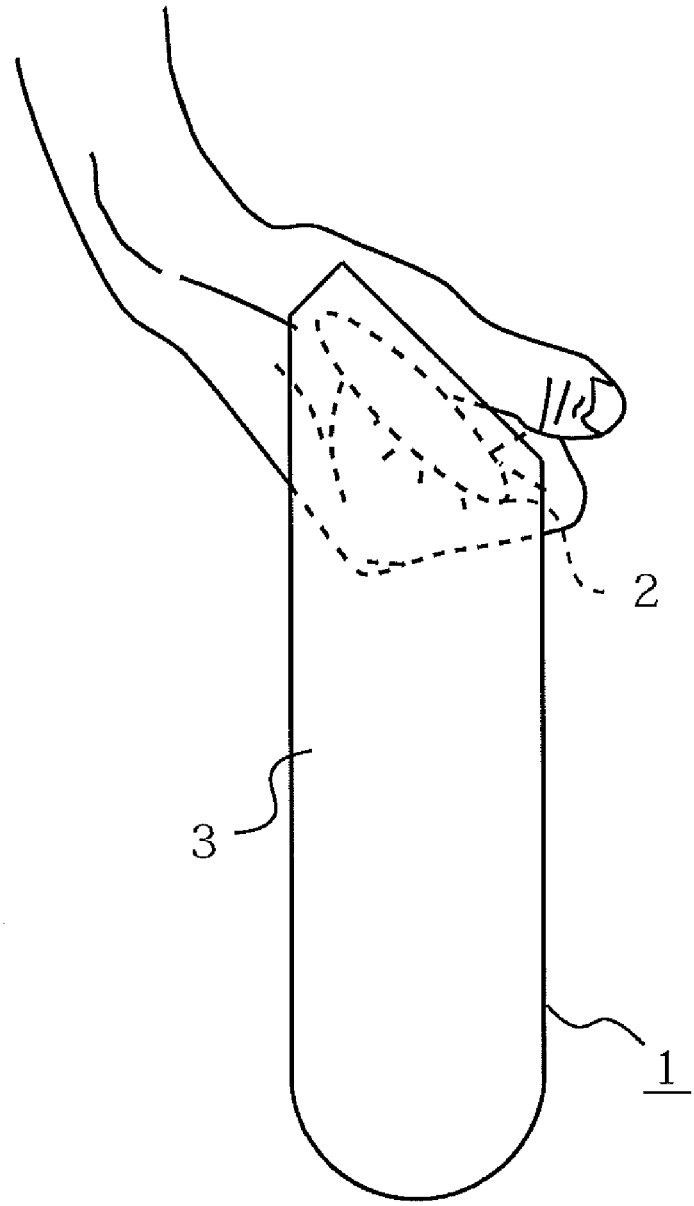
FIG. 8 is a view showing a state where the handle portion 2 is held so that the weight portion 3 points vertically downward.

FIG. 8 is a view showing a state where the handle portion 2 is held so that the weight portion 3 points vertically downward. For example, it can be seen that one needs to use the forearm, not the grip, for moving from the position shown in FIG. 8 to the position shown in FIG. 4. Thus, with exercises shown in FIGS. 4 to 7, it is possible to strengthen the forearm by merely holding the dumbbell 1 still. In other words, the forearm can be strengthened in isometric exercises.

Figure 9A:
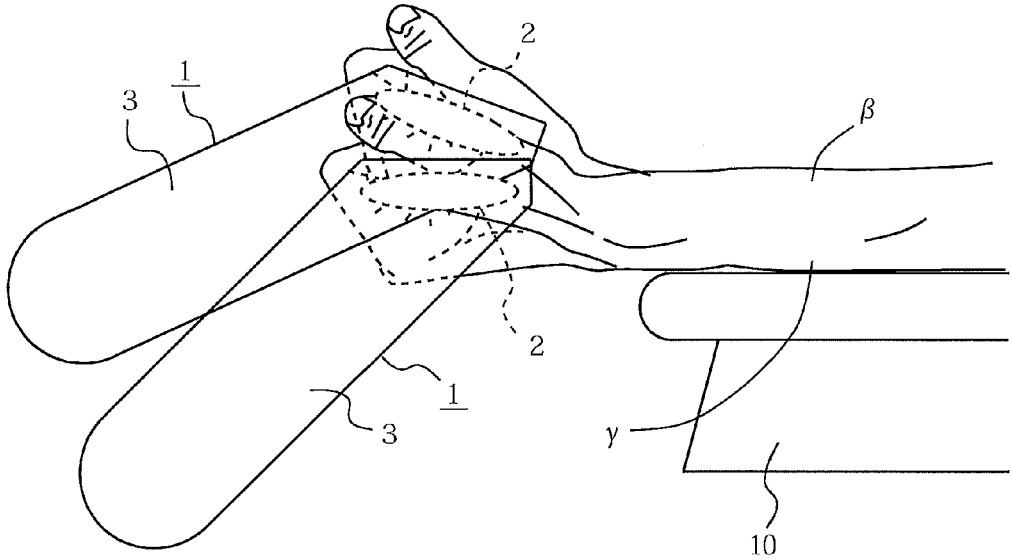
FIG. 9A is a view showing a wrist curl being executed with the arm resting on a bench 10.
Figure 9B:
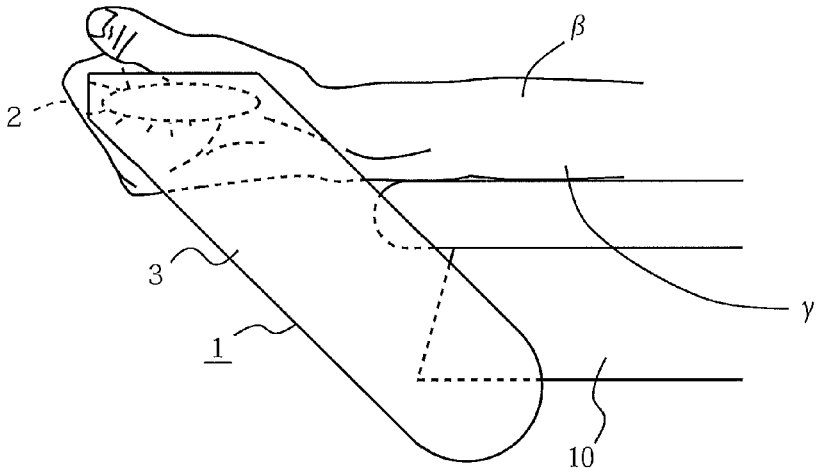
FIG. 9B is a view showing a wrist curl being executed with the arm resting on the bench 10.
Figure 24:
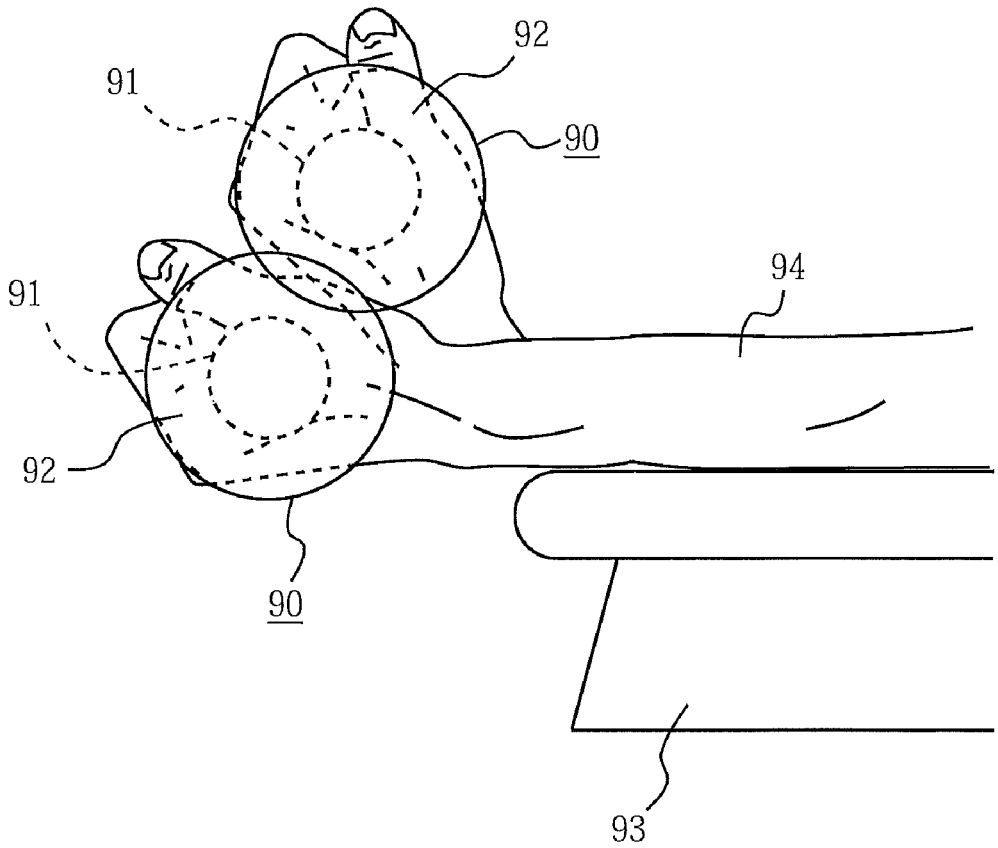
FIG. 24 PRIOR ART
FIG. 24 is a view showing a wrist curl as an exercise example using a conventional dumbbell 90.

FIG. 9A is a view showing an example of a wrist curl being executed with the arm resting on the bench 10. When the dumbbell 1 is used, the forearm needs to exert a force resisting the moment from the weight portions 3. In the exercise shown in FIG. 9A, as compared with that shown in FIG. 24, the forearm needs to exert a force even while the dumbbell 1 is held still. This by itself is an isometric exercise. Moreover, due to the moment from the weight portions 3, a load can be applied effectively on the forearm only by slightly swinging the weight portions 3 up and down. Since the load acts particularly upon the β part, which is the medial part of the forearm, it is possible to effectively strengthen the muscle of the medial part β of the forearm. In the exercise shown in FIG. 24, the dumbbell 90 needs to be swung up and down over a large distance, whereas when the dumbbell 1 is used, a smaller swinging distance is sufficient due to the presence of the moment. Therefore, the dumbbell 1 is a desirable dumbbell with which it is possible to effectively strengthen the forearm by a wrist curl without injuring the wrist joint. FIG. 9B is a view showing another example of a wrist curl being executed with the arm resting on the bench 10. When the dumbbell 1 is held as shown in FIG. 9B, the load acts particularly upon the γ part, which is the lateral part of the forearm, and it is therefore possible to effectively strengthen the muscle of the lateral part γ of the forearm. In order to strengthen the muscle of the lateral part γ of the forearm by a wrist curl using a conventional dumbbell, it is necessary to turn the wrist upside down and flip the dumbbell around. Using the dumbbell 1, however, it is possible to effectively strengthen muscles both on the medial side and the lateral side of the forearm in the same posture. In actual match play, one needs to use muscles both on the medial side and the lateral side in the same posture. Thus, with the dumbbell 1, muscles of the forearm can be strengthened with such a balance that is called for in actual match play.

Figure 10:
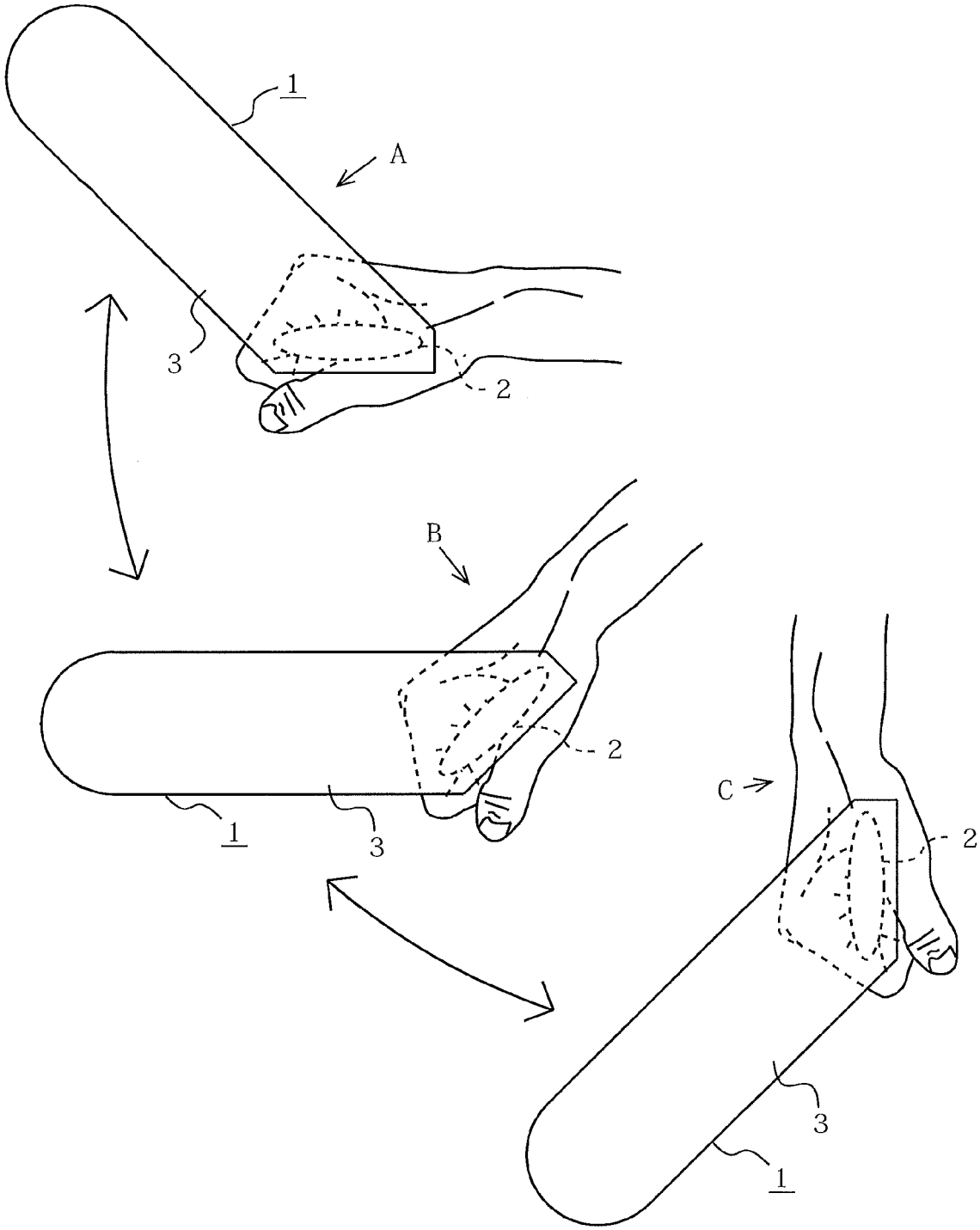
FIG. 10 is a view showing an exercise in which the arm is swung up and down, with the shoulder serving as the fulcrum, while holding the dumbbell 1.

FIG. 10 is a view showing an exercise in which the arm is swung up and down, with the shoulder serving as the fulcrum, while holding the dumbbell 1. Since the handle portion 2 and the weight portion 3 cross each other at a predetermined angle, the weight portion 3 gives a moment about the off-center position, whether the dumbbell 1 and the hand are in the position A, B or C shown in FIG. 10. Therefore, one needs to swing the arm up and down while tightening the forearm so that the weight portions 3 will not move relative to the gripping hand. Thus, by swinging the arm up and down, it is possible to strengthen the forearm more effectively than with conventional equipment while also strengthening muscles in the upper arm and the shoulder. Thus, it is possible to strengthen other muscle parts while holding the dumbbell 1.

Figure 11A:
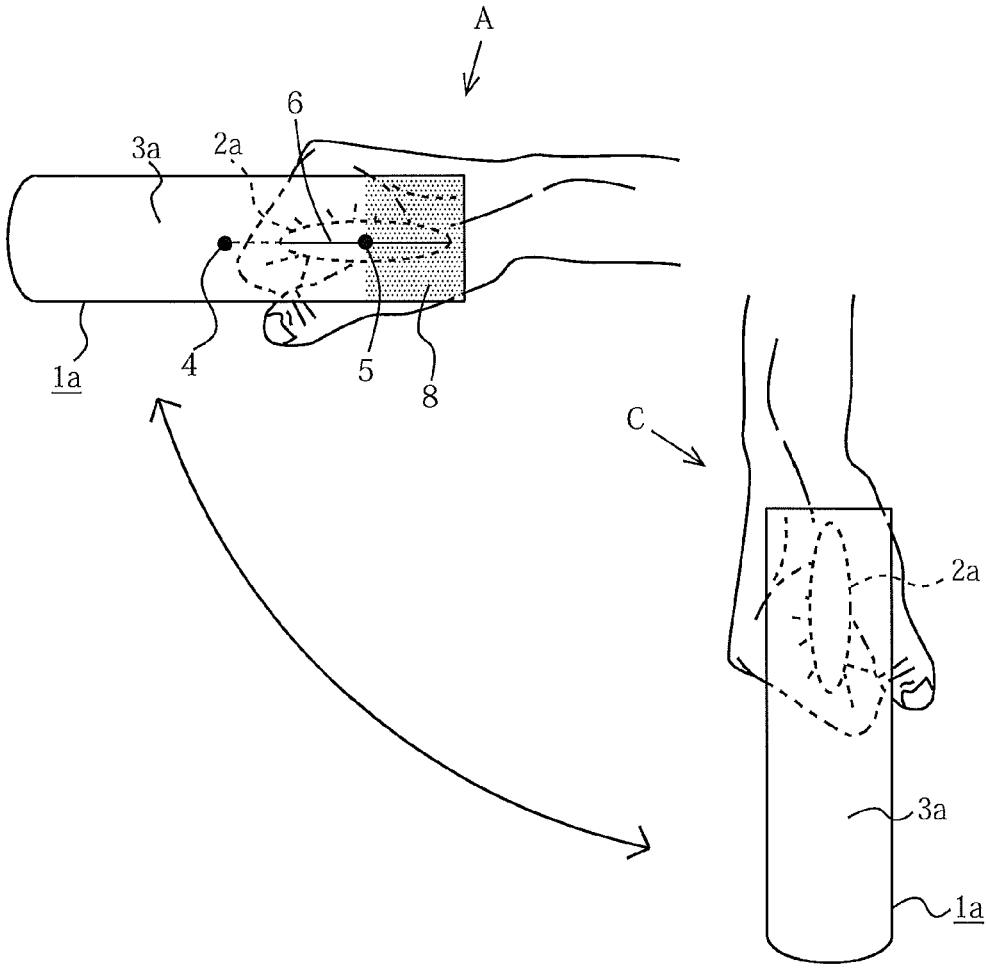
FIG. 11A is a view showing an exercise in which the arm is swung up and down, with the shoulder serving as the fulcrum, using a dumbbell 1*a* of the present invention having an alternative structure.
Figure 11B:
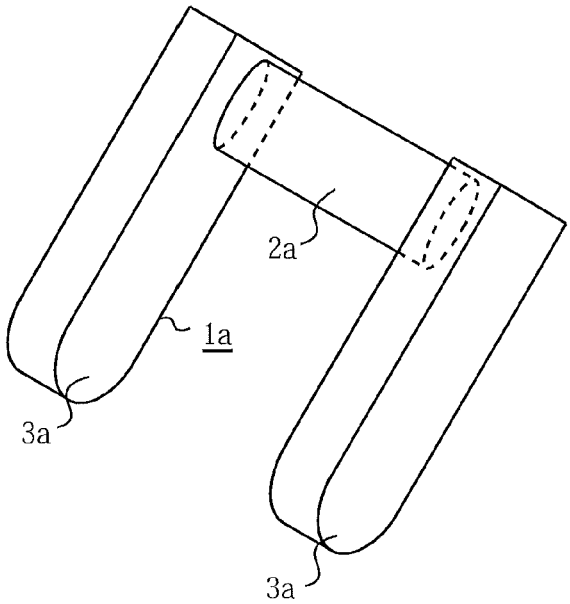
FIG. 11B is a perspective view showing the dumbbell 1*a;*

FIG. 11A is a view showing an exercise in which the arm is swung up and down, with the shoulder serving as the fulcrum, using a dumbbell 1*a* of the present invention having an alternative structure. FIG. 11B is a perspective view showing the dumbbell 1*a*. In the dumbbell 1*a* shown in FIGS. 11A and 11B, the crossing angle between the direction from the off-center position 5 of a handle portion 2*a* toward the center-of-gravity portion 4 of a weight portion 3*a* and a long-side direction 6 of the handle portion 2*a* is 0°. The dumbbell 1*a* is similar to the dumbbell 1 of FIG. 1 except for the angular relationship between the handle portion 2*a* and the weight portions 3*a*. In this case, at the position A shown in FIG. 11A, the forearm is strengthened by the moment from the weight portions 3*a*. Although the moment from the weight portions 3*a* decreases from the position A toward the position C, there is still a moment of some magnitude. Therefore, it can be said that the dumbbell 1*a* is also a dumbbell with which it is possible to effectively strengthen the forearm.

Figure 12A:
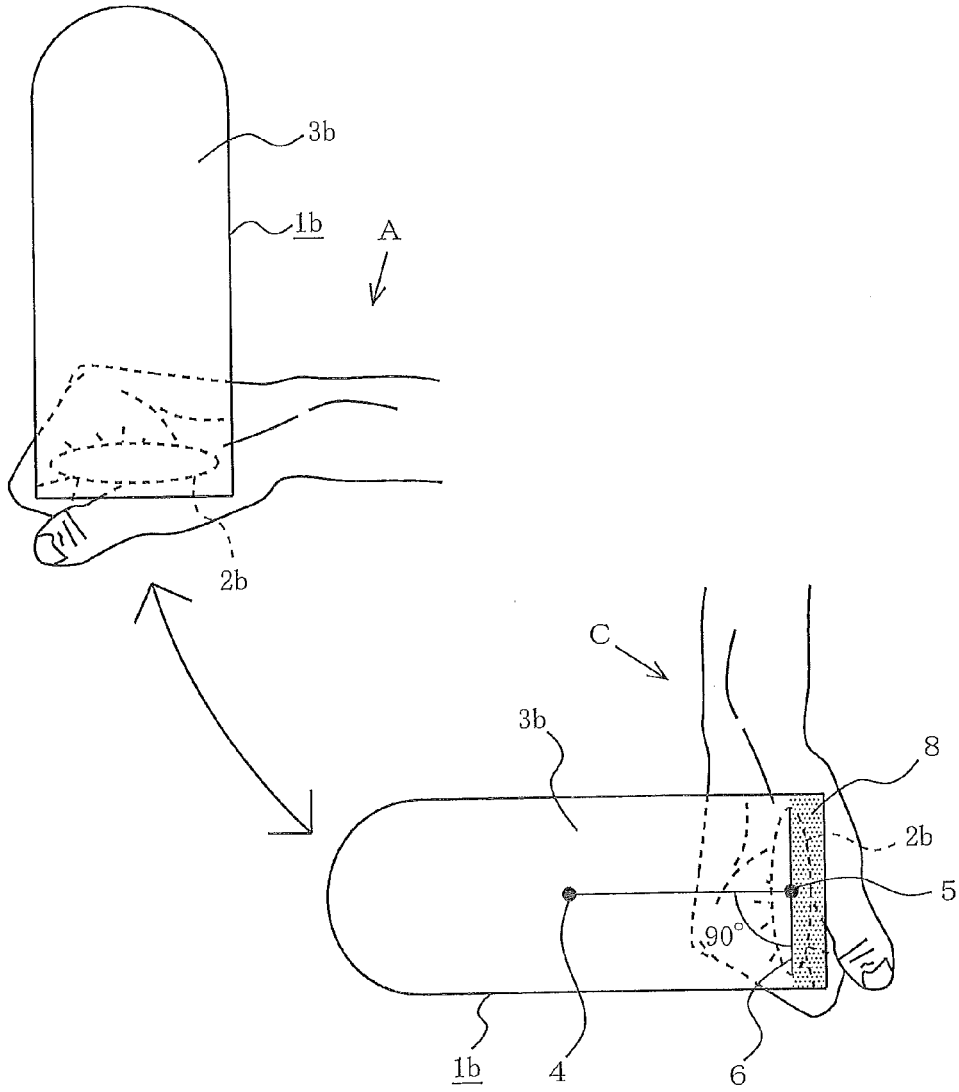
FIG. 12A is a view showing an exercise in which the arm is swung up and down about the shoulder using a dumbbell 1*b* of the present invention having an alternative structure.
Figure 12B:
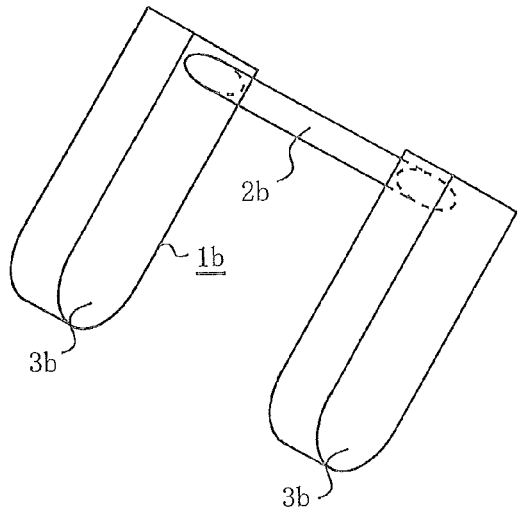
FIG. 12B is a perspective view showing the dumbbell 1*b;*

FIG. 12A is a view showing an exercise in which the arm is swung up and down about the shoulder using a dumbbell 1*b* of the present invention having an alternative structure. FIG. 12B is a perspective view showing the dumbbell 1*a*. In the dumbbell 1*b* shown in FIGS. 12A and 12B, the crossing angle between the direction from the off-center position 5 of a handle portion 2*b* toward the center-of-gravity portion 4 of a weight portion 3*b* and the long-side direction 6 of the handle portion 2*b* is 90°. The dumbbell 1*b* is similar to the dumbbell 1 of FIG. 1 except for the angular relationship between the handle portion 2*b* and the weight portions 3*b*. In this case, at the position C shown in FIG. 12A, the forearm is strengthened by the moment from the weight portions 3*b*. Although the moment from the weight portions 3*b* decreases from the position C toward the position A, there is still a moment of some magnitude. Therefore, it can be said that the dumbbell 1*b* is also a dumbbell with which it is possible to effectively strengthen the forearm.

In the weight portion 3*a* or 3*b* of the dumbbell 1*a* or 1*b*, the weight of a portion 8 of the weight portion that is on the opposite side to the side of the center-of-gravity portion 4 with respect to the off-center position 5 being the boundary (a portion that is shaded with dots in FIGS. 11A and 12A) is preferably less than 10% the total weight of the weight portion. Then, it is possible to minimize the amount of weight to be canceled out. Therefore, it is possible to provide a dumbbell that is light-weight and yet enables effective strengthening of the forearm.

By setting the ellipticity of the cross section of the handle portion 2*a* or 2*b* of the dumbbell 1*a* or 1*b* to be 0.3 or more and less than 1, the handle portion is more reliably held in a fixed orientation, and it is therefore possible to effectively generate the moment from the weight portions. By making the cross section of the handle portion 2*a* or 2*b* of the dumbbell 1*a* or 1*b* in an oblate shape, an elliptic shape, a rounded rectangular shape or a beveled rectangular shape, it is possible to provide a simple and inexpensive dumbbell.

Figure 13:
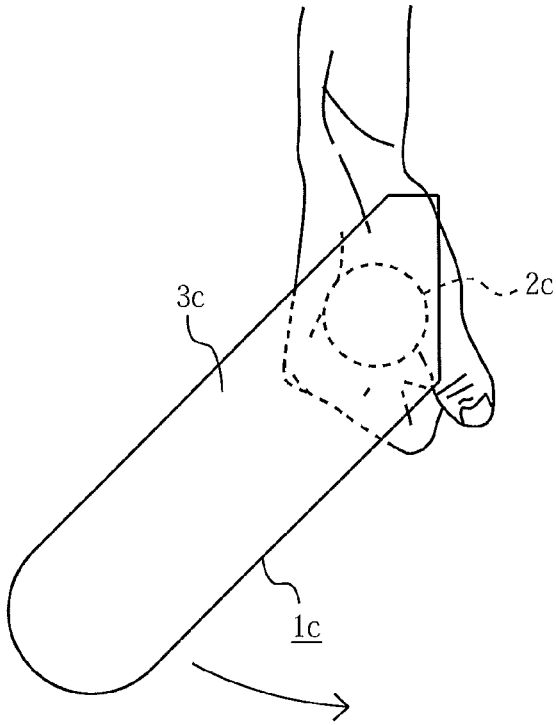
FIG. 13 is a view showing a state where a dumbbell 1*c* having a columnar handle portion 2*c* is used.

FIG. 13 is a view showing a state where a dumbbell 1*c* having a columnar handle portion 2*c* is used. In the dumbbell 1*c* shown in FIG. 13, the handle portion 2*c* is columnar. Then, there is a moment urging weight portions 3*c* to rotate about the off-center position of the handle portion 2*c*, as indicated by an arrow in FIG. 13. In order to resist the rotation, one needs to firmly grip the handle portion 2*c* relying on the grasping power. Therefore, while the dumbbell 1*c* may be used for strengthening one's grasping power, it cannot be said that the dumbbell 1*c* is a dumbbell with which it is possible to effectively strengthen the forearm, as compared with dumbbells of the present invention.

Figure 14:
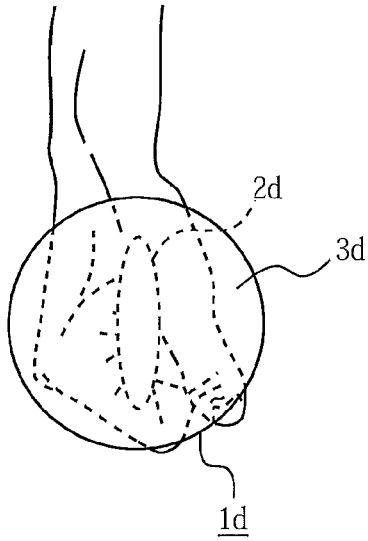
FIG. 14 is a view showing a state where a concentric dumbbell 1*d* is used.

FIG. 14 is a view showing a state where a concentric dumbbell 1*d* is used. The dumbbell 1*d* shown in FIG. 14 includes a handle portion 2*d* having an elliptic cross section. However, the handle portion 2*d* is connected to the center-of-gravity portions of weight portions 3*d*. Therefore, there is little moment from the weight portions 3*d* when the handle portion 2*d* is held. Therefore, it cannot be said that the dumbbell 1*d* is a dumbbell with which it is possible to effectively strengthen the forearm, as compared with dumbbells of the present invention.

Thus, it can be seen that the embodiment of the present invention shown in FIGS. 1 to 12B provides a dumbbell with which it is possible to effectively strengthen the forearm, in which the handle portion 2 has a flattened cross section, and the handle portion 2 is connected to off-center positions of the weight portions 3.

Figure 15:
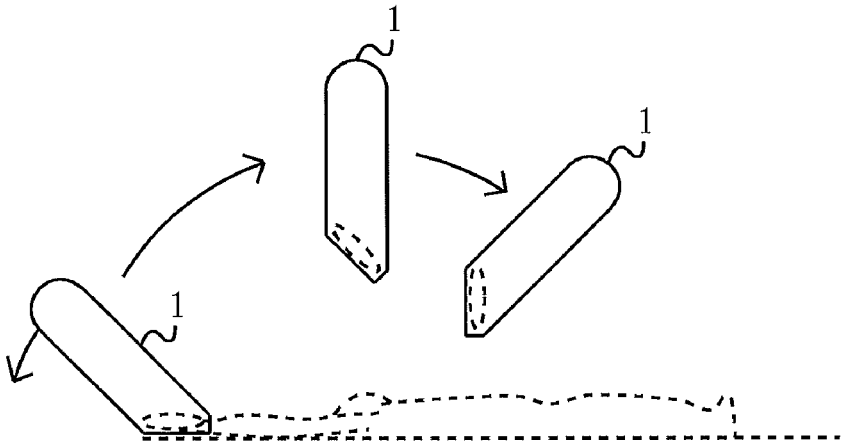
FIG. 15 is a view showing a state where the dumbbell 1 is used in a straight arm pullover, which is a training exercise for swimming, volleyball, etc.

For example, the dumbbell 1 can be used in a beginning movement load training. FIG. 15 is a view showing a state where the dumbbell 1 is used in a straight arm pullover, which is a training exercise for swimming, volleyball, etc. If one holds the dumbbell 1 with the hand stretched out above the head so that the dumbbell 1 is urged to rotate in the downward direction above the head (as indicated by an arrow in FIG. 15), there will be a substantial load at the moment one raises the arm. Thus, the dumbbell 1 is useful in a beginning movement load training. Note that since one needs to hold the dumbbell 1 by tightening the forearm while the arm is being moved, as described above, it is possible to strengthen also the forearm while executing a straight arm pullover. Also when using the dumbbells 1*a* and 1*b*, the exercise shown in FIG. 15 is effective.

Figure 16:
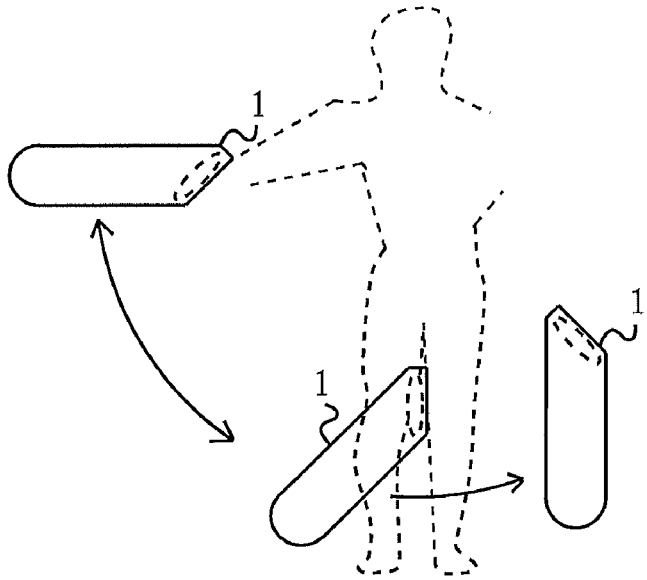
FIG. 16 is a view showing a state where the dumbbell 1 is used in a side raise, which is a training exercise for golf, tennis, etc.

FIG. 16 is a view showing a state where the dumbbell 1 is used in a side raise, which is a training exercise for golf, tennis, etc. When such an exercise as shown in FIG. 16 is executed, there is a load acting when the wrist and the forearm lie along a straight line. Therefore, it is possible to assume an impact point at any intended position by rotating the wrist from the relaxed position where the dumbbell 1 is located vertically downward, and it is therefore possible to strengthen the forearm muscular power at impact at any intended position. Also when using the dumbbells 1*a* and 1*b*, the exercise shown in FIG. 16 is effective.

Figure 17:
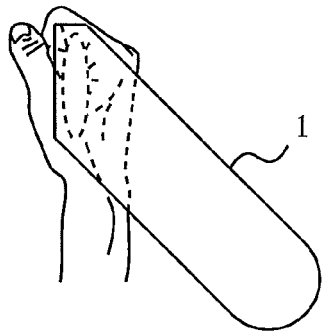
FIG. 17 is a view showing a state where the dumbbell 1 is used in a training exercise for karate, etc.
Figure 18:
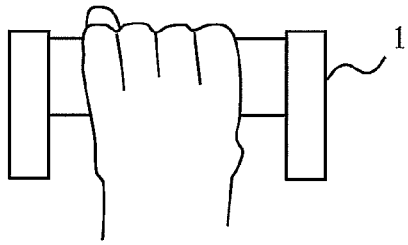
FIG. 18 is a view showing a state where the dumbbell 1 is used in a training exercise for karate, etc.
Figure 19:
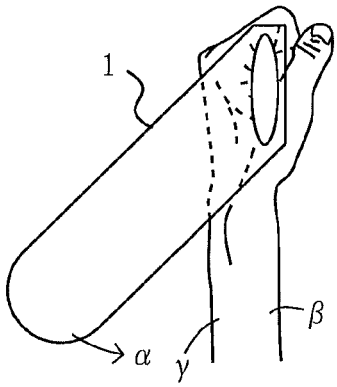
FIG. 19 is a view showing a state where the dumbbell 1 is used in a training exercise for karate, etc.

FIGS. 17 to 19 are views each showing a state where the dumbbell 1 is used in a training exercise for karate, etc. FIGS. 17 and 18 show the dumbbell 1 as viewed from above. First, as in a forefist punch of karate, the dumbbell 1 is held as shown in FIG. 6 so that the weight portion 3 points upward. Then, one thrusts the arm forward while twisting the wrist into such a position as shown in FIG. 18. FIG. 19 shows the dumbbell 1 held in the position of FIG. 18, as viewed from the right side. Where one executes a forefist punch while holding the dumbbell 1 as shown in FIG. 17, the distance over which the weight portion 3 moves is minimized, thus reducing the unnecessary load, when the arm is moved with the shoulder serving as the fulcrum. Since the arm is moved while holding the dumbbell 1, one can enhance the punching force while strengthening the forearm. Particularly, since the weight portion 3 is urged to rotate in the direction of an arrow $\alpha$ of FIG. 19, a load acts also upon the lower (medial) forearm $\beta$ shown in FIG. 19, resisting the rotation. With a conventional dumbbell, although the upper (lateral) forearm $\gamma$ can be strengthened by resisting the weight of the dumbbell, the lower forearm $\beta$ cannot be strengthened effectively. In order to enhance the punching force, it is necessary to enhance the snapping force. In order to enhance the punching force, it is effective to apply a load on the lower forearm. With the dumbbell 1, since a load acts also upon the lower forearm $\beta$, it is possible to enhance the punching force while strengthening the lower forearm. In the motion of FIGS. 17 to 19, since the weight portion 3 is positioned against the path, i.e., the weight portion 3 is urged to rotate toward the forearm, the dumbbell 1 effectively acts also on those muscles that are needed for "twisting" motions, which are frequent in sports. Also when using the dumbbells 1*a* and 1*b*, the exercise shown in FIGS. 17 to 19 is effective.

Referring to FIGS. 4 to 7, the dumbbell 1 can be held in any of four different orientations, i.e., downward and to the lateral side of the forearm (FIG. 4), upward and to the lateral side of the forearm (FIG. 6), downward and to the medial side of the forearm (FIG. 5), and upward and to the medial side of the forearm (FIG. 7). A different set of these four holding orientations exists for each of the right hand and the left hand. During the initial use of the dumbbell 1, one may not readily know how to hold the dumbbell 1 for an intended one of the four holding orientations. In view of this, it is preferred to mark the dumbbell 1 so that one can know the holding orientation.

Figure 20:
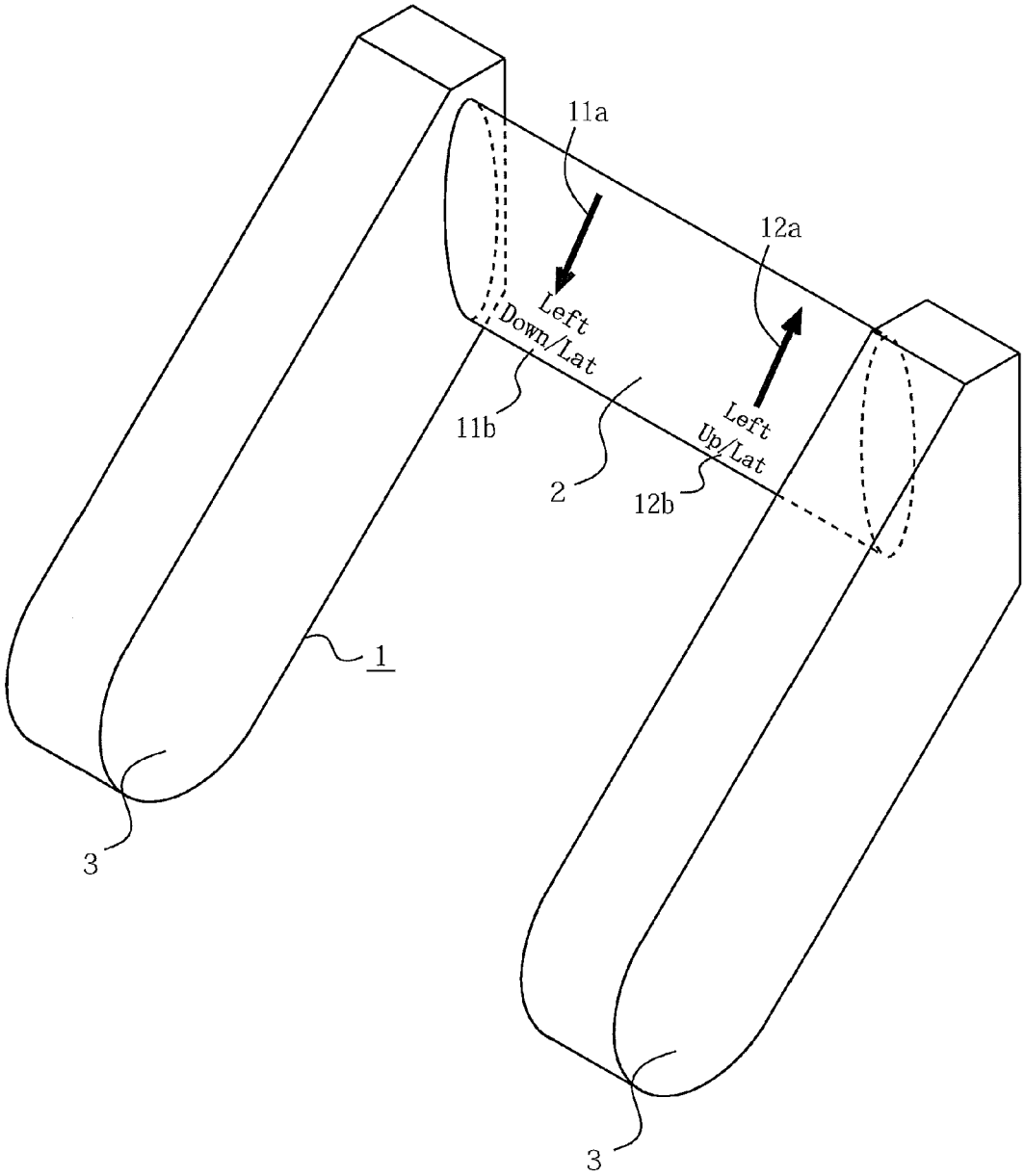
FIG. 20 is a view showing an example of how to mark the dumbbell 1.

FIG. 20 is a view showing an example of how to mark the dumbbell 1. FIG. 20 shows an example of how to mark the dumbbell 1 for use with the left hand. Arrows 11*a* and 12*a* in FIG. 20 each indicate the direction in which the index finger of the left hand is placed, from the base toward the tip of the finger. If the index finger of the left hand is placed in the direction of the arrow 11*a*, the dumbbell 1 can be held so that the weight portion 3 points downward and to the lateral side of the left forearm, as indicated by characters 11*b*. If the index finger of the left hand is placed in the direction of the arrow 12*a*, the dumbbell 1 can be held so that the weight portion 3 points upward and to the lateral side of the left forearm, as indicated by characters 12*b*. Similarly, arrows and characters are provided also on the reverse side of the handle portion 2. It is preferred that arrows and characters for the right hand are provided on the handle portion 2 in a different color or font. It is understood that there may be a dumbbell 1 for the right hand and another dumbbell 1 for the left hand, with arrows and characters for the right hand and those for the left hand provided on these dumbbells 1, respectively. As described above, it is preferred that the handle portion 2 has marks (arrows or characters) thereon indicating the orientation of the weight portion 3 when the handle portion 2 is held.

Figure 21:
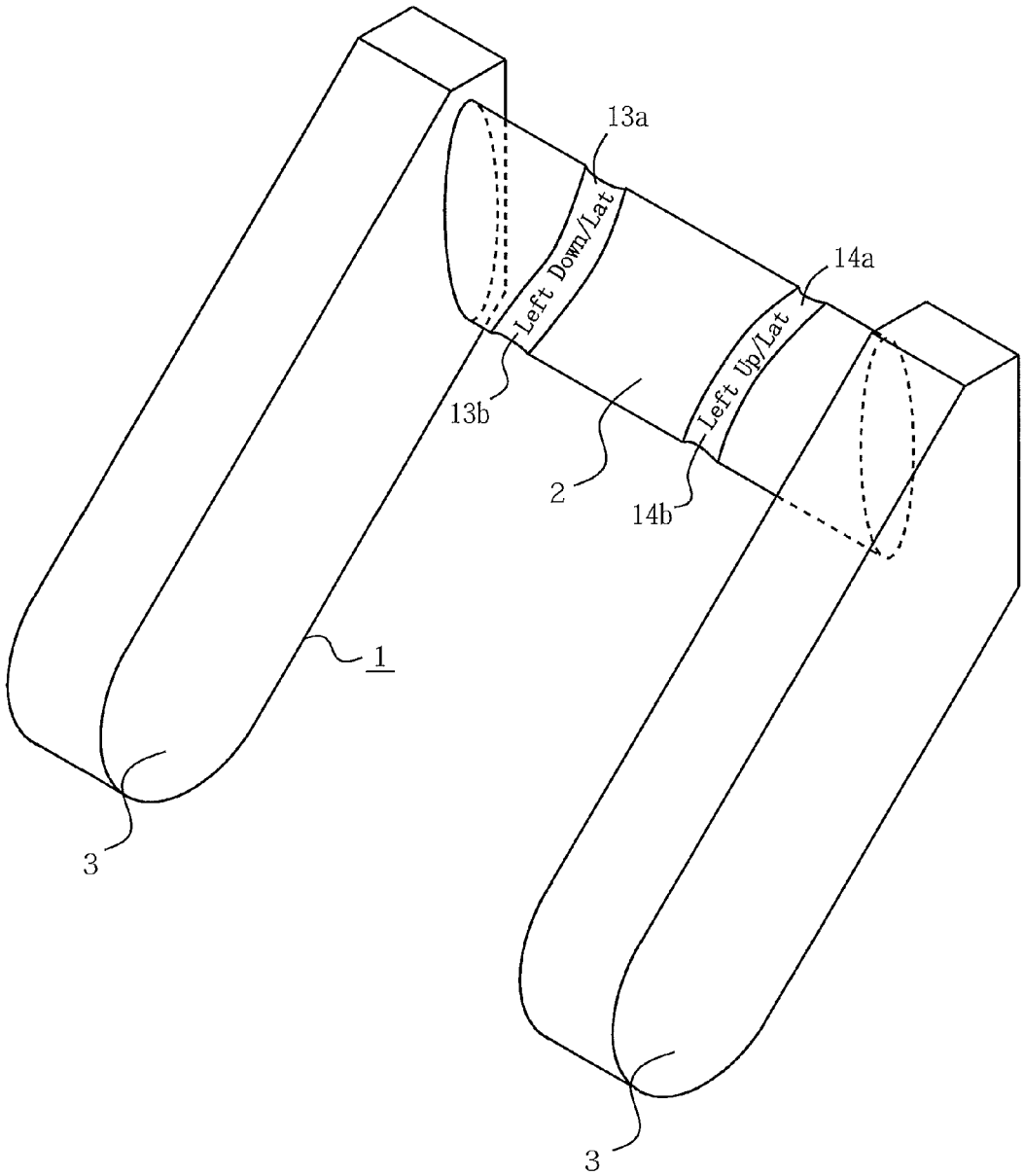
FIG. 21 is a view showing an example of how to mark the dumbbell 1.

FIG. 21 is a view showing an example of how to mark the dumbbell 1. In FIG. 21, depressed portions each having a size of about a fingertip are provided in the handle portion 2 as marks for use with the left hand. As one places the index finger of the left hand along a depressed portion 13*a*, the dumbbell 1 can be held so that the weight portion 3 points downward and to the lateral side of the left forearm, as indicated by characters 13*b*. As one places the index finger of the left hand along a depressed portion 14*a*, the dumbbell 1 can be held so that the weight portion 3 points upward and to the lateral side of the left forearm, as indicated by characters 14*b*. Similarly, depressed portions each having a size of a fingertip with characters thereon are provided also on the reverse side of the handle portion 2. It is preferred that depressed portions each having a size of a fingertip with characters thereon for the right hand are provided also on the handle portion 2 in a different color or font. It is understood that there may be a dumbbell 1 for the right hand and another dumbbell 1 for the left hand, with depressed portions and characters for the right hand and those for the left hand provided on these dumbbells 1, respectively. As described above, the handle portion 2 may be provided with depressed portions each indicating the orientation of the weight portion 3 when the handle portion 2 is held. With such a depressed portion, one can intuitively recognize the holding orientation based on how the finger fits to the depressed portion.

Figure 22:
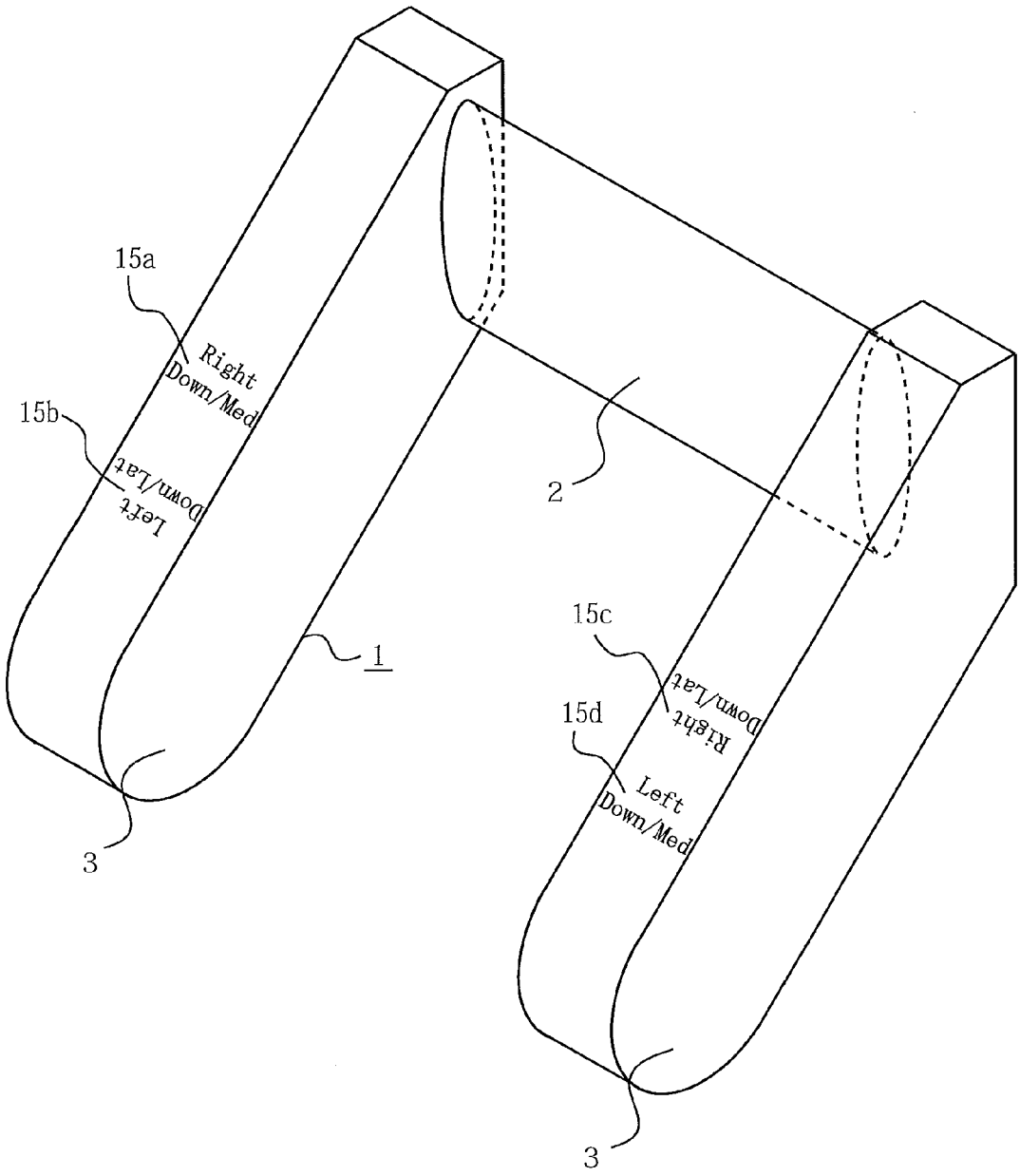
FIG. 22 is a view showing an example of how to mark the dumbbell 1.

FIG. 22 is a view showing an example of how to mark the dumbbell 1. In FIG. 22, characters 15*a* to 15*d* each indicating a direction are provided as marks on the weight portion 3. When one holds the dumbbell 1 in the left hand so that the characters 15*b* written horizontally on the weight portion 3 in front of the body read normally (i.e., without the characters being upside down), the weight portion 3 points downward and to the lateral side of the left forearm, as indicated by the characters 15*b*. Similarly, when one holds the dumbbell 1 in the right hand so that the characters 15*a* written horizontally in front of the body read normally, the weight portion 3 points downward and to the medial side of the right forearm, as indicated by the characters 15*a*. This similarly applies to the characters 15*c* and 15*d*. Similar characters are provided also on the reverse side of the weight portion 3. A mark indicating the orientation may be provided on the weight portion 3, as described above. Note that characters for use with the right hand and those for use with the left hand may be provided in different colors or fonts.

Note that the methods of marking shown in FIGS. 20 to 22 are merely illustrative, and the present invention is not limited thereto.

Such marks as shown in FIG. 20 may be provided also on the handle portions 2*a* and 2*b* of the dumbbells 1*a* and 1*b*, such depressed portions as shown in FIG. 21 may be provided on the handle portions 2*a* and 2*b*, and such marks as shown in FIG. 22 may be provided on the weight portions 3*a* and 3*b*.

Figure 23:
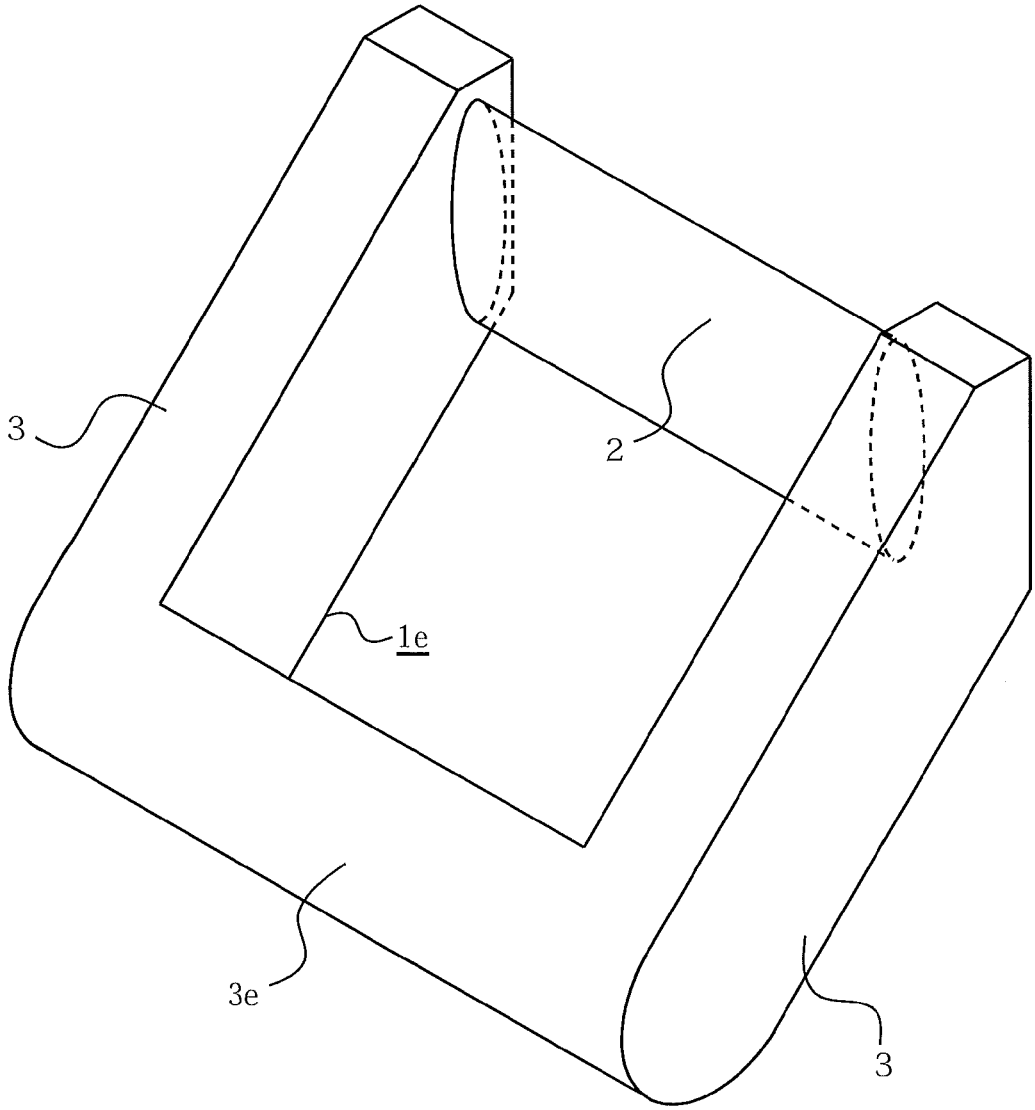
FIG. 23 is a perspective view showing a dumbbell 1*e* according to another embodiment of the present invention.

FIG. 23 is a perspective view showing a dumbbell 1*e* according to another embodiment of the present invention. In FIG. 23, like elements to those of the dumbbell 1 of FIG. 1 are denoted by like reference numerals. The dumbbell 1*e* further includes a connecting weight portion 3*e* that connects together the two weight portions 3. Thus, it is possible to further increase the weight of the dumbbell 1*e*. Note that also in the dumbbell 1*e*, as in the dumbbell 1, it is preferred that the total weight of portions of the two weight portions that are on the opposite side to the side of the center-of-gravity portion with respect to the off-center position being the boundary is preferably less than 10% the total weight of the weight portions (the total weight of the weight portions 3 and the connecting weight portion 3*e*). Also in the dumbbell 1*e*, as in the dumbbell 1, the crossing angle is preferably 40° or more and 50° or less. It is also preferred that the dumbbell 1*e* has various marks thereon, as does the dumbbell 1.

As described above, the embodiment of the present invention provides a dumbbell suitable for strengthening the wrist, i.e., the forearm. The present invention also provides a dumbbell with which the forearm can be strengthened by only holding the dumbbell. The present invention further provides a dumbbell with which it is possible to strengthen other muscle parts while holding the dumbbell. Thus, the present invention provides a dumbbell with which it is possible to strengthen the muscular power with such a balance that is called for in actual match play of a sport, while strengthening the forearm. Note that the dumbbell of the present embodiment is suitable for a beginning movement load training. Since the dumbbell is provided with marks each indicating the orientation of the weight portion when the handle portion is held, the dumbbell is easy to use even for a person who has never used the dumbbell. The dumbbell of the present embodiment has a very simple structure, but is yet very effective in strengthening the forearm and is thus very useful.

While the invention has been described in detail, the foregoing description is in all aspects illustrative and not restrictive. It is understood that numerous other modifications and variations can be devised without departing from the scope of the invention.

What is claimed is:

1. A dumbbell, comprising:

a grip configured and sized for grasping by having a flattened cross section that provides a major axis and a minor axis when viewed in cross-section, thus enabling torque transmission through the grip; and at least two weight portions having first ends provided at opposite ends of the grip, the two weight portions having a second major axis and projecting from the grip in parallel along the second major axis and together with the grip defining a substantially U-shape, second ends of the weight portions distal to the grip having an open space therebetween such that a user's hand can freely pass directly between the second ends;

wherein the grip is directly connected to each of the weight portions at an off-center position deviating from a center-of-gravity portion of each of the weight portions, and, when viewed from an end of the grip looking in a longitudinal direction of the grip, an angle between a direction from the off-center position toward the center-of-gravity portion along the second major axis of the two weight portions and a direction parallel to the major axis of the grip is between 20° and 80°.

2. The dumbbell according to claim 1, wherein a weight of a portion of the weight portion that is on one side of the grip is less than 10% of a total weight of the weight portion.

3. The dumbbell according to claim 1, wherein the angle is from 40° to 50°, inclusively.

4. The dumbbell according to claim 1, wherein the grip is provided with a mark indicating an orientation of the weight portion when the grip is held.

5. The dumbbell according to claim 1, wherein:

the grip includes a plurality of depressed portions each having a size of a fingertip; and the plurality of depressed portions indicate a plurality of orientations of the weight portion for holding the grip.

6. The dumbbell according to claim 1, wherein the weight portion is provided with a plurality of marks indicating a plurality of orientations of the weight portion for holding the grip.

7. The dumbbell according to claim 1, wherein a ratio of the major axis to the minor axis of the cross section of the grip is from 0.3, inclusively, to 1, exclusively.

8. The dumbbell according to claim 1, wherein a cross section of the grip has an oblate shape, an elliptic shape, a rounded rectangular shape or a beveled rectangular shape.

9. The dumbbell according to claim 1, wherein the grip is a primary grip.

10. The dumbbell according to claim 1, wherein the first ends of the weight portions are fixed to respective opposite ends of the grip.

11. A dumbbell, comprising:

a single grip configured and sized for grasping by having a flattened cross section that provides a major axis and a minor axis when viewed in cross-section, thus enabling torque transmission through the grip; and at least two weight portions having first ends fixed at opposite ends of the grip, the two weight portions having a second major axis and projecting from the grip in parallel along the second major axis, second ends of the weight distal to the grip having a connecting weight portion that connects together the two weight portions fixed at respective second ends of the two weight portions, an entirely open space being defined between the grip, the two weight portions and the connecting weight portion;

wherein the grip is directly connected to each of the weight portions at an off-center position deviating from a center-of-gravity portion of each of the weight portions, and, when viewed from an end of the grip looking in a longitudinal direction of the grip, an angle between a direction from the off-center position toward the center-of-gravity portion along the second major axis of the two weight portions and a direction parallel to the major axis of the grip is between 20° and 80°.

* * * * *